US010681444B2

(12) United States Patent
Kamimura

(10) Patent No.: US 10,681,444 B2
(45) Date of Patent: Jun. 9, 2020

(54) HEADPHONE DEVICE

(71) Applicant: JVCKENWOOD Corporation, Yokohama-shi, Kanagawa (JP)

(72) Inventor: Shinji Kamimura, Yokohama (JP)

(73) Assignee: JVCKENWOOD CORPORATION, Yokohama-Shi, Kanagawa (JP)

( * ) Notice: Subject to any disclaimer, the term of this patent is extended or adjusted under 35 U.S.C. 154(b) by 0 days.

(21) Appl. No.: 16/514,985

(22) Filed: Jul. 17, 2019

(65) Prior Publication Data

US 2020/0029146 A1 Jan. 23, 2020

(30) Foreign Application Priority Data

Jul. 18, 2018 (JP) ..... 2018-134732

(51) Int. Cl.
*H04R 1/10* (2006.01)
*H04R 5/033* (2006.01)

(52) U.S. Cl.
CPC ..... *H04R 1/1008* (2013.01); *H04R 1/105* (2013.01); *H04R 1/1066* (2013.01); *H04R 5/0335* (2013.01); *H04R 2201/107* (2013.01)

(58) Field of Classification Search
CPC .... H04R 1/1008; H04R 1/105; H04R 1/1058; H04R 1/1066; H04R 5/033; H04R 5/0335; H04R 2201/107; H04M 1/05
USPC ..... 381/309, 370, 374, 376, 377, 378, 379, 381/383; 181/128, 129; 2/209
See application file for complete search history.

(56) References Cited

U.S. PATENT DOCUMENTS 4,571,746 A * 2/1986 Gorike ..... H04R 5/0335 2/209
8,737,668 B1 * 5/2014 Blair ..... H04R 1/1066 381/378
2014/0023222 A1 * 1/2014 Ito ..... H04R 5/0335 381/379

FOREIGN PATENT DOCUMENTS

JP 2017-98869 A 6/2017

* cited by examiner

*Primary Examiner* — Huyen D Le
(74) *Attorney, Agent, or Firm* — Nath, Goldberg & Meyer; Jerald L. Meyer

(57) ABSTRACT

A headphone device includes a head pad, a band, and a sleeve. The band extends from an edge of the head pad and supports a housing, via a hanger, housing a speaker unit at a tip of the band. The sleeve is slidable along the head pad and the band to adjust a length of a deformable part of the band.

4 Claims, 8 Drawing Sheets

HEADPHONE DEVICE

CROSS REFERENCE TO RELATED APPLICATION

This application is based upon and claims the benefit of priority under 35U.S.C. § 119 from Japanese Patent Application No. 2018-134732 filed on Jul. 18, 2018, the entire contents of which are incorporated herein by reference.

BACKGROUND

The present disclosure relates to a headphone device enabling a lateral pressure adjustment.

Japanese Patent Application Publication No. 2017-098869 (Patent Literature 1) discloses a headphone device enabling a lateral pressure to be adjusted when worn on the head.

The headphone device disclosed in Patent Literature 1 includes a plate spring to be put across the head of a user and corresponding to a typical head band having both ends to be located around the right and left ears, and further includes a lateral-pressure adjustable spring, an adjuster, and spacers arranged between the lateral-pressure adjustable spring and the adjuster, so as to adjust a lateral pressure together with the plate spring.

SUMMARY

The headphone device disclosed in Patent Literature 1 inevitably increases the number of components, which should be reduced, necessary for adjusting a lateral pressure.

The headphone device disclosed in Patent Literature 1 has the further disadvantage of hindering the user from visually recognizing a level of a lateral pressure to be adjusted. The headphone device impedes an easy and quick adjustment to a lateral pressure fit for each individual user when several users use the common headphone device, for example. Thus, a need exists for facilitating the adjustment to a lateral pressure to be fit for each user.

An aspect of one or more embodiments provides a headphone device including: a head pad; a band extending from an edge of the head pad and supporting a housing, via a hanger, housing a speaker unit at a tip of the band; and a sleeve slidable along the head pad and the band to adjust a length of a deformable part of the band.

DETAILED DESCRIPTION

Figure 1:
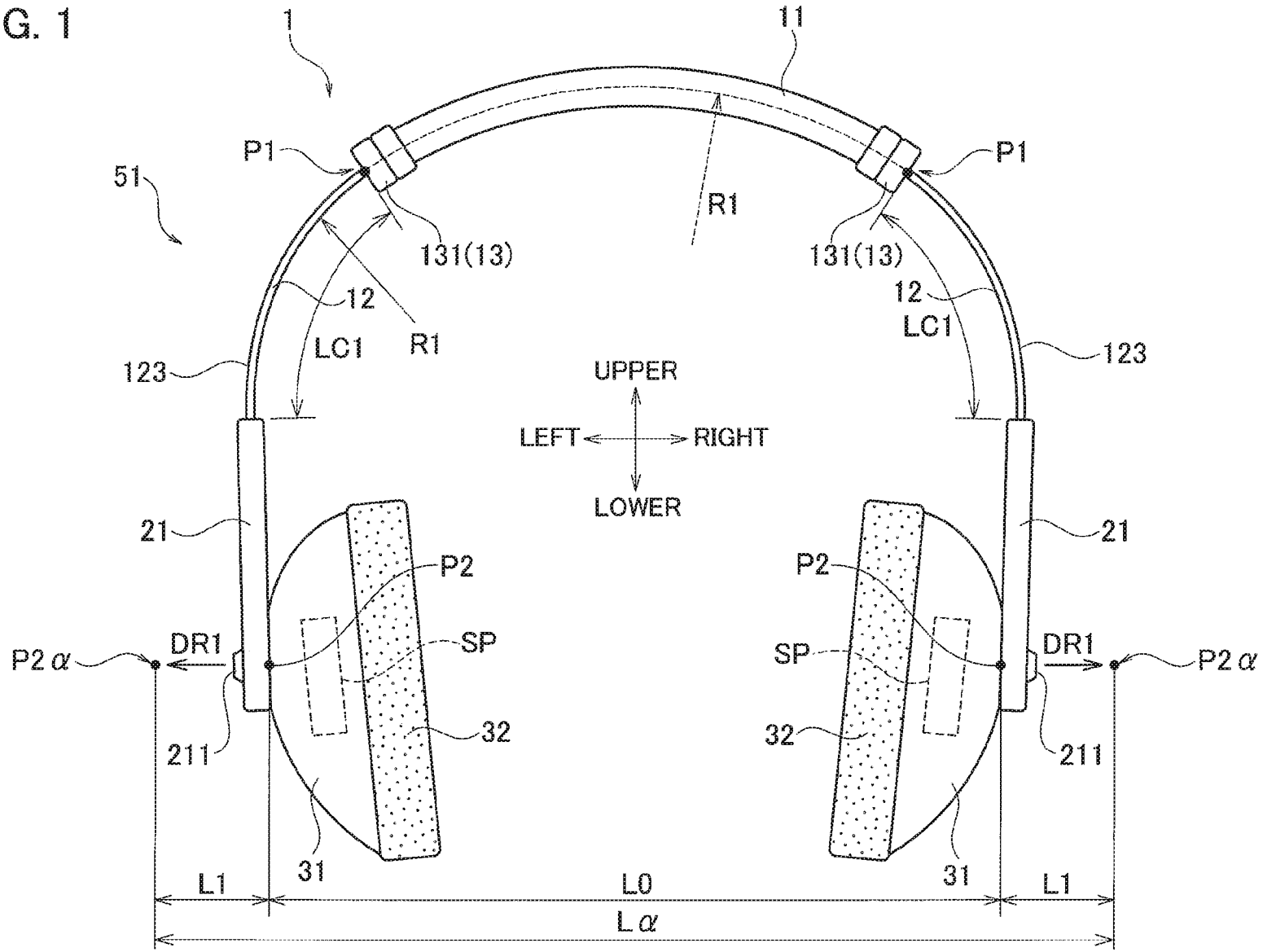
FIG. 1 is a rear view showing a headphone device in a first state according to one or more embodiments.
Figure 2:
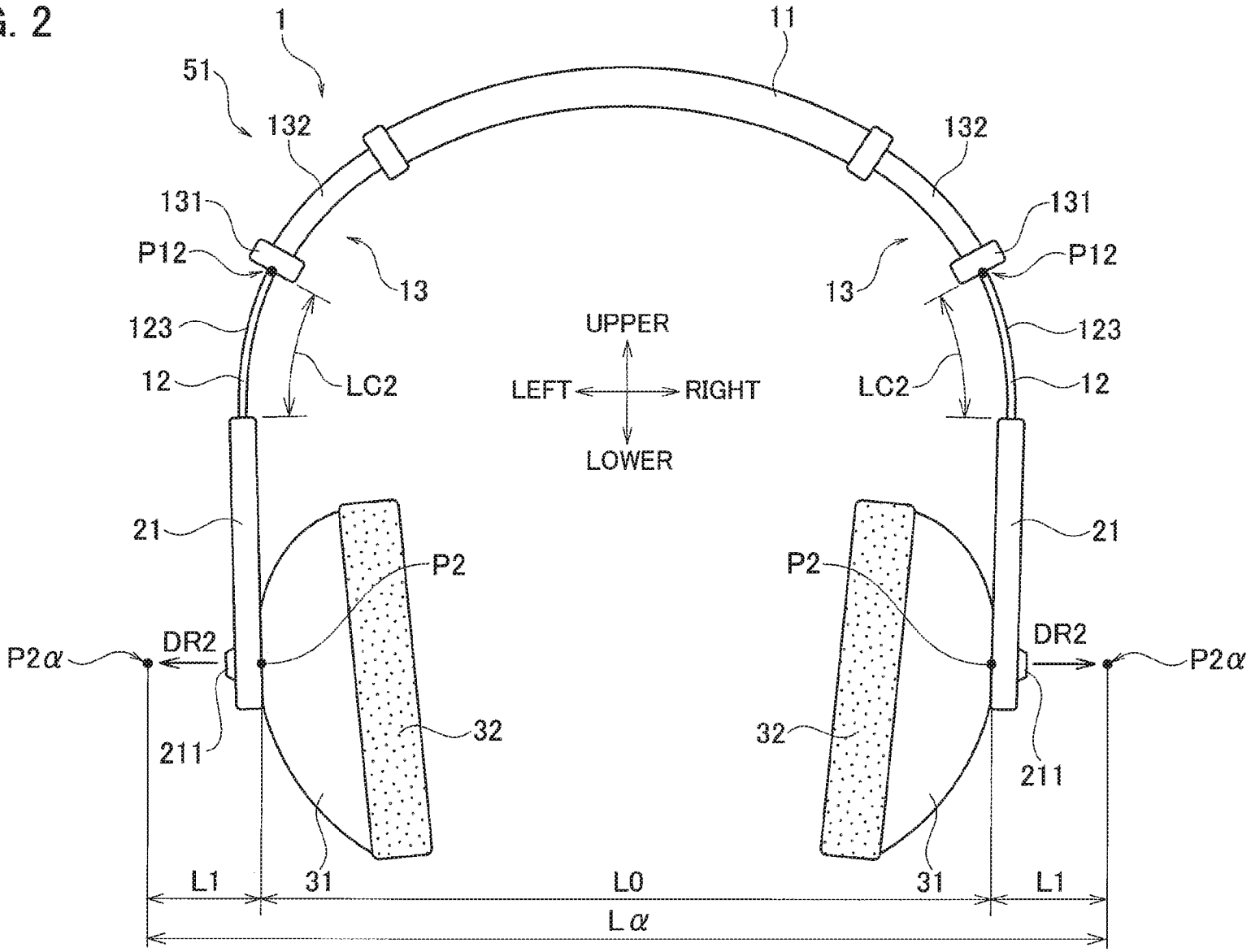
FIG. 2 is a rear view showing the headphone device in a second state according to one or more embodiments.

FIG. 1 and FIG. 2 are rear views showing a headphone device in first and second states according to one or more embodiments. The upper, lower, left, and right directions are indicated by the arrows shown in FIG. 1 and FIG. 2. The front side on the paper of each of FIG. 1 and FIG. 2 is defined as a rear side. The exterior structure of the headphone device 51 is described below with reference to FIG. 1 and FIG. 2.

As shown in FIG. 1 and FIG. 2, the headphone device 51 includes a head band 1, a hanger 21 and a housing 31 for the left ear attached to the left end of the head band 1, and a hanger 21 and a housing 31 for the right ear attached to the right end of the head band 1.

The head band 1 includes a head pad 11 housing extendable and retractable sleeves 13. The sleeves 13 are slidably moved by fingers of a user along a band 12 extending from the head pad 11 so as to be freely drawn out of the head pad 11. The first state and the second state described below differ in the drawn amount of the sleeves 13 to be slid.

In particular, the first state corresponds to a state in which the drawn amount of the sleeves 13 is zero, and the second state corresponds to a state in which the sleeves 13 are drawn out to the maximum.

The headphone device 51 yields a lateral pressure that varies depending on the drawn amount of the sleeves 13. The lateral pressure is a pressure applied around the temples of the user of the headphone device 51 via ear pads 32. The user of the headphone device 51 can adjust a level of the lateral pressure by regulating the drawn amount of the sleeves 13.

Each of the hangers 21 includes a pivot support 211 at its bottom to pivotally support the housing 31. The housing 31 houses a speaker unit to emit sounds toward the opposite housing 31 in the state shown in FIG. 1. The ear pad 32, in contact with each ear when the headphone device 51 is worn on the head, is attached on the sound-emitting side of the housing 31.

The head band 1 includes the head pad 11, the band 12, and the sleeves 13. The head pad 11 is placed on the top of the head, for example, when the headphone device 51 is worn on the head. The head pad 11 is an arc-like sheath-shaped housing having an approximate radius R1 in the front view. The head pad 11 includes a plurality of resin-based members combined together, for example.

The band 12 is an arc-like flat member made of metal or resin and having flexibility in the increasing/decreasing direction of the diameter. The band 12 has both plate-like end portions connected and inserted to the respective hangers 21, and an arc-like middle portion having the same radius R1 as the head pad 11 in the front view.

The middle portion of the band 12 in the longitudinal direction (in the left-right direction in FIG. 1) is inserted and fixed to the inside of the head pad 11, and each of the right and left end portions extends out of the head pad 11. The extending right and left ends of the band 12 are connected to the respective hangers 21.

The hangers 21 having a known structure used in a conventional headphone device are each vertically adjustable with respect to the band 12. FIG. 1 and FIG. 2 each show a state in which the hangers 21 are located at the uppermost position with respect to the band 12.

The sleeves 13 are each a concentric arc-like sheath-shaped housing made of resin or metal and having a radius R1 at a position where the band 12 penetrates. At least part of the sleeves 13 is extendably and retractably housed in the sheath-shaped head pad 11. The sleeves 13 are slidably attached to the band 12 in the longitudinal direction.

The head band 1 can be set in the following first to third states: The first state is a state in which the sleeves 13 are totally housed in the head pad 11 (FIG. 1). The second state is a state in which the sleeves 13 are drawn out of the head pad 11 to the maximum along the band 12 (FIG. 2). The third state is a state between the first state and the second state in which the sleeves 13 are drawn out not to the maximum but by a freely-selected amount from the first state (not shown).

A flexural rigidity of the sleeve 13 is preferably, but not necessarily, greater than or equal to that of the band 12.

Figure 3:
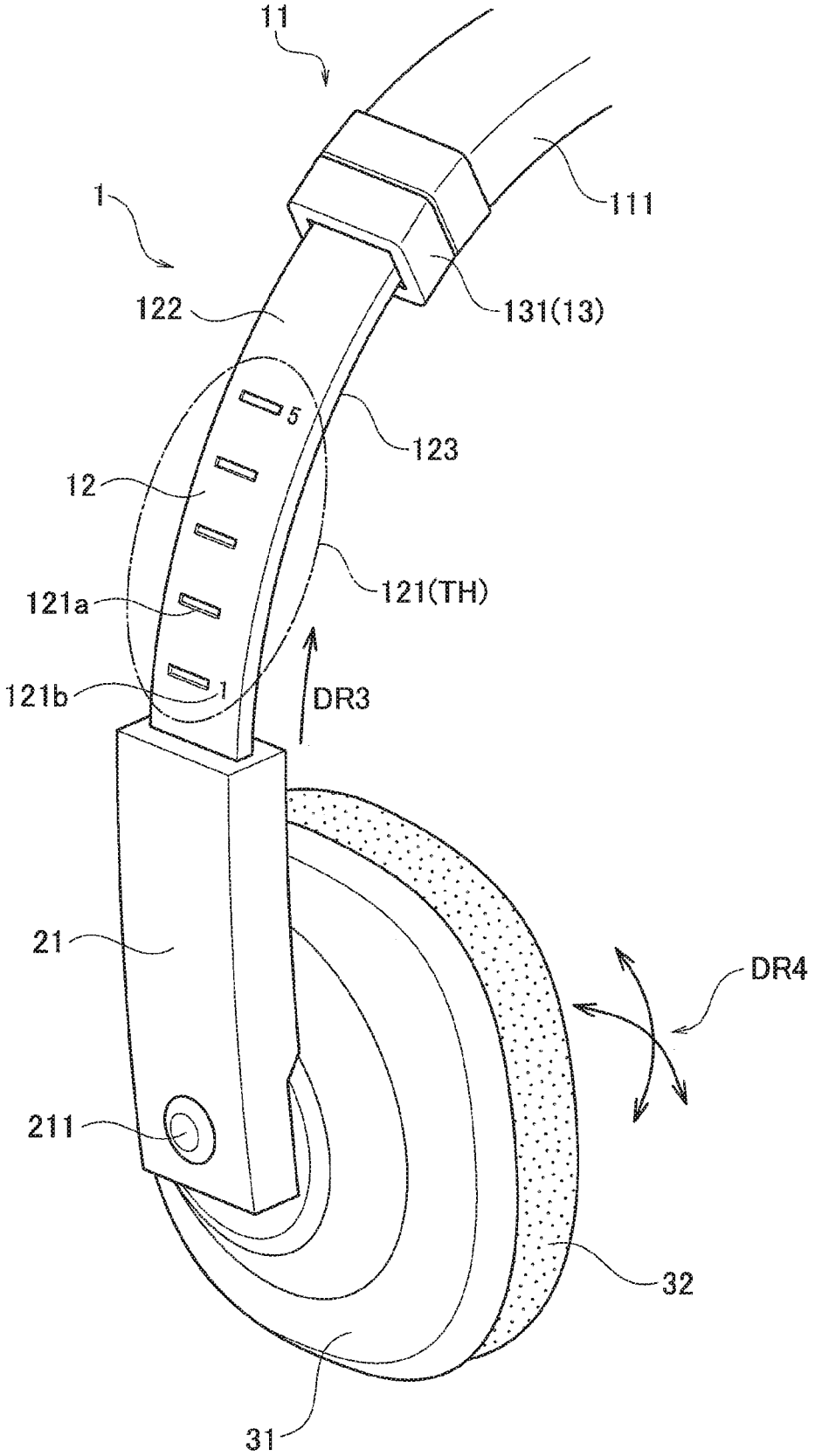
FIG. 3 is a partial perspective view showing a band of the headphone device in the first state according to one or more embodiments.
Figure 4:
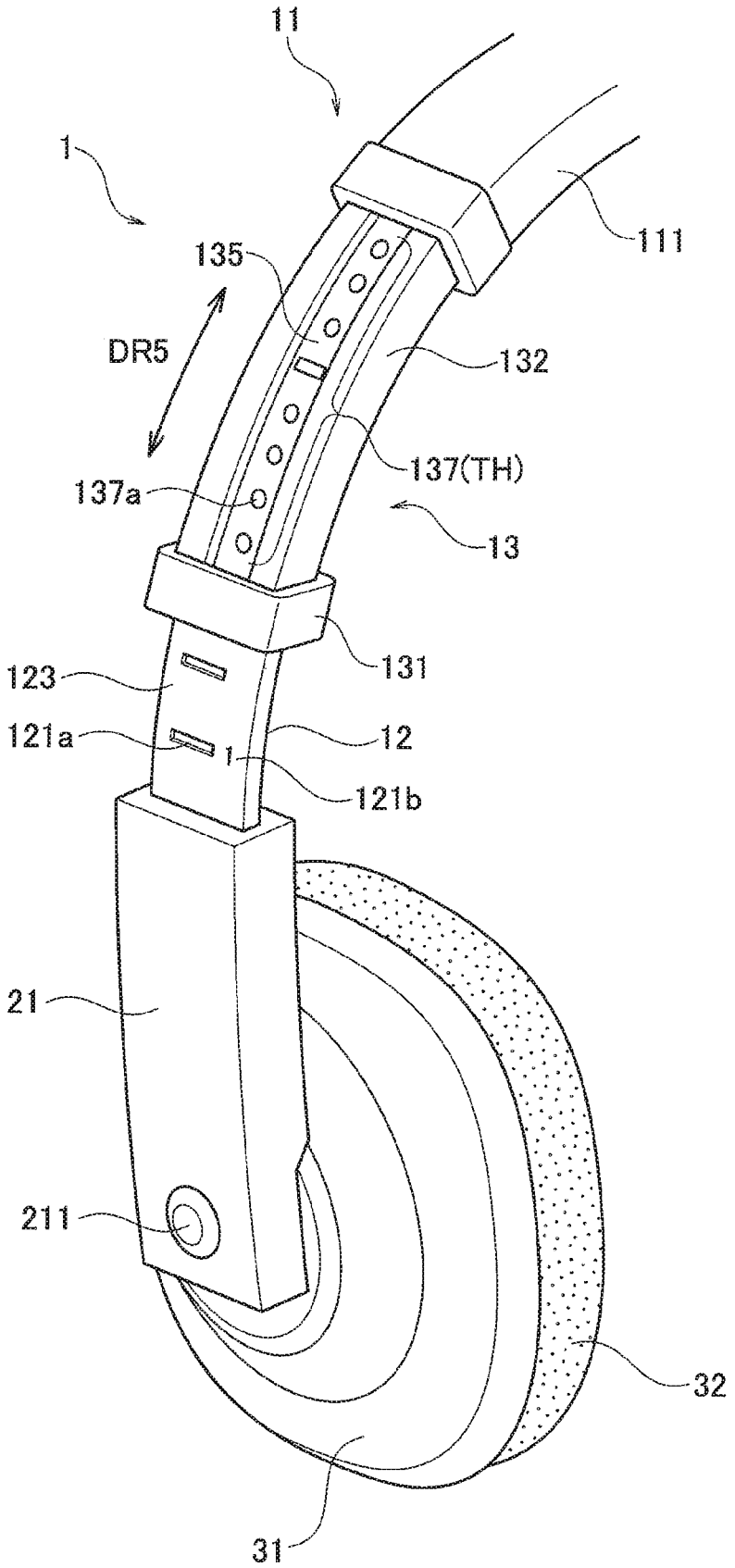
FIG. 4 is a partial perspective view showing the band of the headphone device in the second state according to one or more embodiments.

FIG. 3 and FIG. 4 are partial perspective views showing the band 12 in the first state and the second state of the head band 1.

As shown in FIG. 3, the outer surface 122 of the band 12 on the outer side of the headphone device 51 is provided with hanger position indicators 121. The hanger position indicators 121 are marks for positioning the hanger 21 in the vertical direction, which are a group of slightly recessed marks 121*a* and 121*b*. The hanger position indicators 121 collectively serve as an adjusted-amount recognition part TH so as to allow the user to visually recognize the adjusted position of the hanger 21.

The marks illustrated in FIG. 3 include linear marks 121*a* and numerical marks 121*b*, for example.

The user, when moving each hanger 21 upward in the direction indicated by the arrow DR3 to adjust the vertical position, can easily recognize the position of the moved hanger 21 supporting the housing 31 due to the marks not hidden but still remaining visible on the hanger 21.

As shown in FIG. 3, the housing 31 pivots on the pivot support 211 at a predetermined angle in the vertical direction and the front-rear direction indicated by the arrows DR4.

Figure 5:
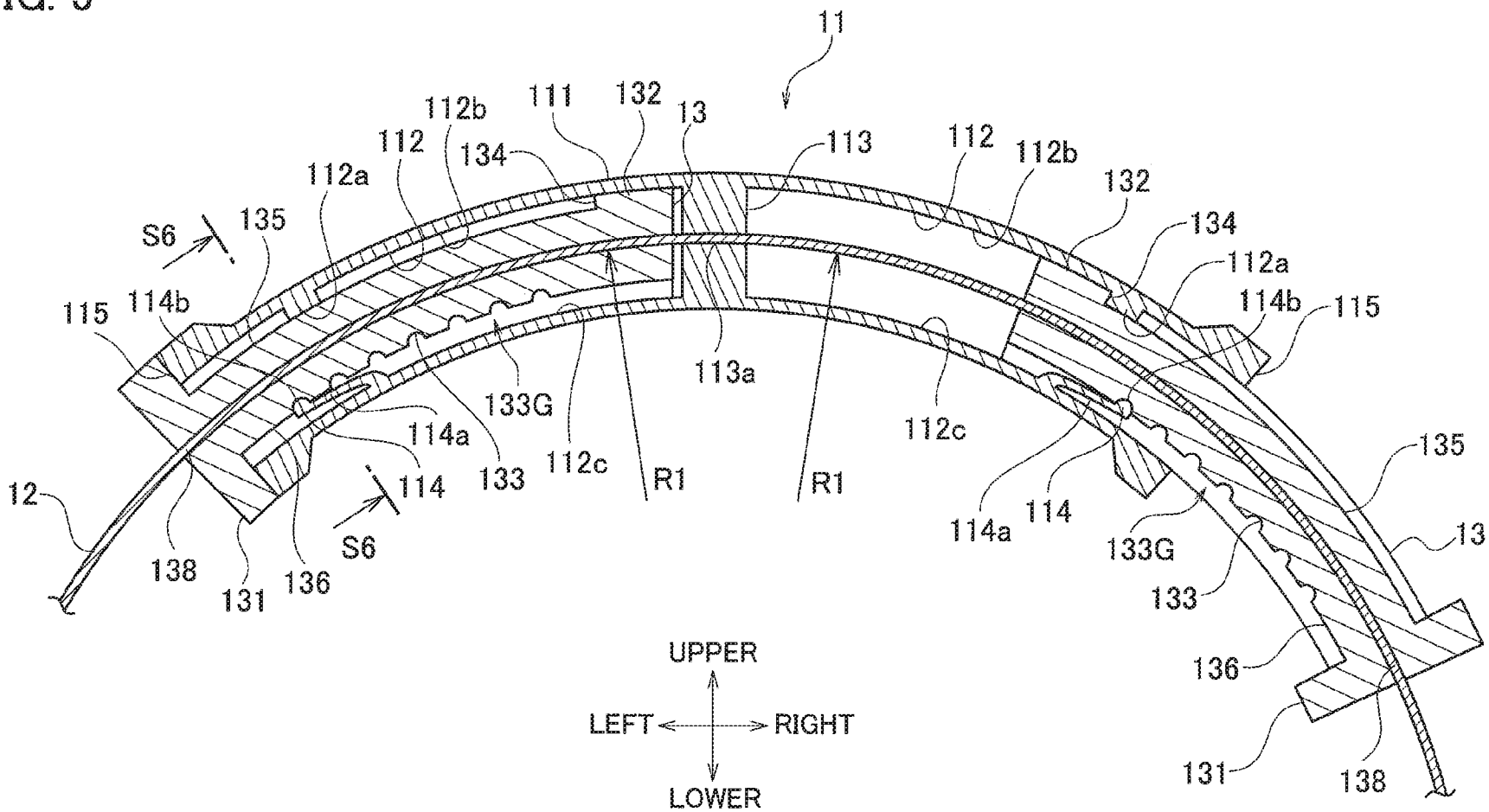
FIG. 5 is a vertical cross-sectional view showing a head pad included in the headphone device according to one or more embodiments.

Next, the internal structure of the head pad 11 and the extending/retracting movement of the sleeves 13 are illustrated below mainly with reference to FIG. 5 and FIG. 6. FIG. 5 is a vertical cross-sectional view of the head pad 11 along the middle portion in the front-rear direction, and FIG. 6 is a lateral cross-sectional view taken along line S6-S6 in FIG. 5.

As shown in FIG. 5, the head pad 11 includes a concentric arc-shaped pad base portion 111 having a radius R1 at a radial position at which the band 12 penetrates in the front view. The pad base portion 111 is a sheath-shaped housing having a symmetric rectangular shape in lateral cross section.

The pad base portion 111 includes a fixed wall portion 113 in the middle in the right-left direction to serve as a partition wall, and a pair of housing portions 112 open at the left and right ends to define the right and left internal spaces partitioned by the fixed wall portion 113. The paired housing portions 112 have a symmetric shape. The housing portion 112 on the left side is mainly described below.

Figure 6:
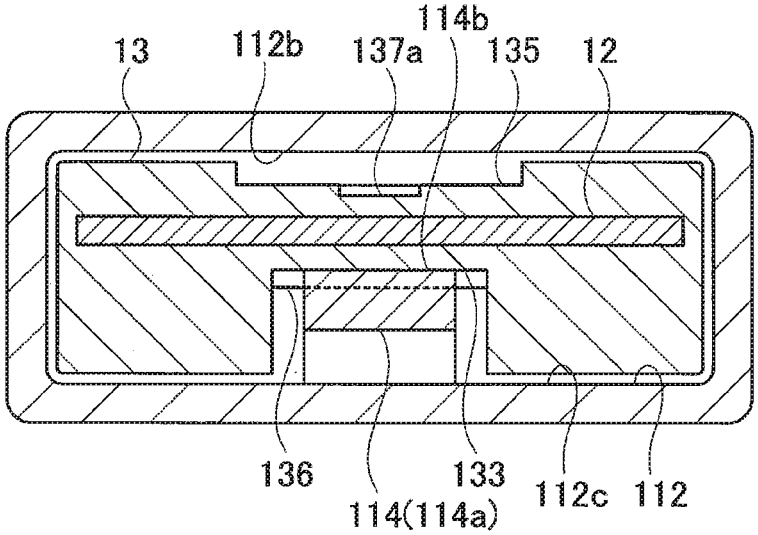
FIG. 6 is a cross-sectional view taken along line S6-S6 in FIG. 5.

As shown in FIG. 6, the housing portion 112 has a rectangular shape in lateral cross section. As shown in FIG. 5, an upper inner wall 112*b* of the housing portion 112 is provided with a stopper 112*a* projecting downward and located closer to the left end. A lower inner wall 112*c* of the housing portion 112 has an engagement arm portion 114 projecting upward at a position corresponding to the stopper 112*a*.

The engagement arm portion 114 includes an arm piece 114*a* flexible in the vertical direction, and a semicolumnar engagement projection 114*b* elongated in the front-rear direction and protruding upward at the tip of the arm piece 114*a*.

The fixed wall portion 113 has a penetration hole 113*a* through which the right and left housing portions 112 communicate with each other. The band 12 is inserted into the penetration hole 113*a* and fixed to the penetration hole 113*a* in the middle with an adhesive, for example, so as to be integrated with the head pad 11.

The sleeves 13 are described in more detail below. The two sleeves 13 included in the head band 1 are symmetrically housed in the right and left housing portions 112. The sleeve 13 housed in the housing portion 112 on the left side is mainly described below.

The sleeve 13 is a sheath-shaped member having an arc-like shape in the front view and having a rectangular shape in lateral cross section. The sleeve 13 has an arc-shaped penetration hole 138 open at both ends and having a radius R1. The band 12 is slidably inserted to the penetration hole 138.

The sleeve 13 includes a base 132 and a sleeve head 131. The base 132 can be entirely housed in the housing portion 112. The sleeve head 131 projects outward on the circumference at the end on the opposite side of the base 132 (on the left side), and is in contact with an end surface 115 of the pad base portion 111.

The sleeve 13 has an outer groove 135. The outer groove 135 is a portion of the base 132 on the outer diameter side of the head band 1, which is hollowed out toward the inner diameter of the head band 1 in the middle in the front-rear direction.

The outer groove 135 extends from the bottom of the sleeve head 131 to a part adjacent to the right end of the base 132, and has a contact portion 134 at the right end serving as a wall.

The contact portion 134 comes into contact with the stopper 112*a* at the predetermined maximum extending position so that a further slide is regulated when the sleeve 13 is slid to be drawn out of the head pad 11.

As shown in FIG. 4 or FIG. 6, the bottom of the outer groove 135 is provided with a plurality of marks 137*a* slightly recessed at regular intervals so as to collectively serve as a sleeve length indicating portion 137. As shown in FIG. 4, the sleeve length indicating portion 137 is a group of the marks 137*a* formed into recesses aligned at regular intervals in the longitudinal direction of the sleeve 13.

The sleeve 13 has an inner groove 136. The inner groove 136 on the inner diameter side of the head band 1 is hollowed out toward the outer diameter of the head band 1 in the middle in the front-rear direction. The inner groove 136 continuously extends to the end of the base 132, namely, extends from the bottom of the sleeve head 131 to the right end of the base 132.

The bottom of the inner groove 136 is provided with a plurality of engagement recesses 133 hollowed into a semicircle in cross section at regular intervals in the right-left direction and elongated in the front-rear direction. The engagement recesses 133 are collectively referred to as an engagement recess group 133G. Each of the engagement recesses 133 can engage with the engagement projection 114*b* when the sleeve 13 is inserted to be slid in the housing portion 112 of the head pad 11.

The head pad 11, having the structure as described above, can allow the user of the headphone device 51 to slide the sleeve 13 with the fingers so that the sleeve 13 is drawn out of/retracted into the pad base portion 111 in the direction as indicated by the double-headed arrow DR5 in FIG. 4.

When the sleeve 13 is moved to be drawn out of/retracted into the pad base portion 111, the engagement projection 114*b* of the pad base portion 111 elastically engages with one of the engagement recesses 133 in the engagement recess group 133G of the sleeve 13 located at a position corresponding to the drawn/retracted amount of the sleeve 13. The engagement between the engagement projection 114*b* and each engagement recess 133 can be released when the sleeve 13 is slid with power applied to a certain extent.

The user thus can feel the sense of clicking at predetermined moving intervals while moving the sleeve 13 to be drawn out of/retracted into the pad base portion 111. The sleeve 13 is held at any position while being releasable with the fingers.

The sleeve length indicating portion 137, which is the group of the marks 137*a* aligned at regular intervals, can allow the user to easily recognize the drawn position of the sleeve 13, namely, the drawn amount of the sleeve 13 by a visual check, thus allowing a highly-repeatable adjustment.

Aligning the predetermined pitch of the engagement recesses 133 provided on the bottom of the inner groove 136 with the predetermined interval between the respective marks 137*a* in the sleeve 13, enhances the correlation between the drawn position and the drawn amount of the sleeve 13, further facilitating the adjusting operation.

The headphone device 51 provided with both the hanger position indicators 121 and the sleeve length indicating portion 137 can allow the user to recognize both the vertical adjustment position of the hanger 21 with respect to the band 12 and the drawn position of each sleeve 13 with respect to the band 12.

The headphone device 51 including the above head band 1 enables the lateral pressure adjustment in association with the change in the drawn amount of the sleeves 13 drawn out of the head pad 11 as described above. The lateral pressure adjustment is described in detail below.

FIG. 1 and FIG. 2 each show a natural state of the headphone device 51 in the first state and the second state with no power applied. The user, when putting the headphone device 51 on the head, widens the distance between the pair of the housings 31 in the right-left direction to wear the housings 31 over the ears. The head band 1 is thus deformed to be widened outward. An elastic repulsive force of the head band 1 in response to the deformation pushes the ears or temples of the user via the ear pads 32, and the user senses the elastic repulsive force as a lateral pressure.

The supported position of each housing 31 on the hanger 21 is referred to below as a reference point P2 to estimate expansion and contraction of the head band 1. The distance between the reference points P2 on the right and left sides of the pair of the housings 31 in the natural state shown in FIG. 1 is defined as distance L0.

When the headphone device 51 in the first state is put on the head, the head band 1 is widened to shift the reference points P2 to in-use reference points P2α outside the reference points P2 in the directions indicated by the arrows DR1. The shifted distance L1 from each reference point P2 to each in-use reference point P2α substantially corresponds to the deformed amount at the tip part of the head band 1.

When the flexural rigidity is sufficiently greater for each of the head pad 11, the hanger 21, and the sleeves 13 than for the band 12, the base of the band 12 toward the sleeve head 131 serves as a deformation fulcrum P1 when the head band 1 is deformed. A part of the band 12 having an arm length LC1, which is a creepage distance between the deformation fulcrum P1 and the base of the hanger 21, is mainly deformed. The part corresponding to the arm length LC1 is a deformable part 123 of the band 12 in the first state. The arm length LC1 is the substantial length of the deformable part 123 of the band 12 in the first state.

When the headphone device 51 in the second state in which the sleeves 13 are drawn out to the maximum is put on the head, the reference points P2 are shifted to the in-use reference points P2α in the directions indicated by the arrows DR2, as in the case of the first state. The shifted distance L1 from each reference point P2 to each in-use reference point P2α is thus the same as in the first state.

However, the position of the deformation fulcrum differs from that in the first state, since the sleeves 13 are drawn out to cover part of the band 12 toward the head pad 11.

The deformation of the head band 1 fundamentally depends on the deformation of the band 12 because of the flexural rigidity which is sufficiently greater for the sleeves 13 than for the band 12. The base of the band 12 toward the sleeve head 131 of each sleeve 13 after being drawn out then serves as a deformation fulcrum P12. The band 12 is thus deformed along a part having an arm length LC2 which is a creepage distance between the deformation fulcrum P12 and the base of the hanger 21. The part corresponding to the arm length LC2 is a deformable part 123 of the band 12 in the second state. The arm length LC2 is the substantial length of the deformable part 123 of the band 12 in the second state.

The configuration of the headphone device 51 described above allows each sleeve 13 to be slid to adjust the arm length which is the length of the deformable part 123 of the band 12. The arm length LC2 in the second state is shorter than the arm length LC1 in the first state by the drawn amount of the sleeve 13 slid out. The bend angle of the deformed band 12 when the reference point P2 is shifted by the shifted distance L1 is greater in the second state than in the first state, and the elastic repulsive force is thus greater in the second state than in the first state, leading to the greater lateral pressure applied to the user in the second state.

The shifted distance L1 of the reference point P2 does not vary with the drawn amount of each sleeve 13. The elastic repulsive force of the band 12 thus can be regulated depending on the drawn amount of the sleeves 13. The lateral pressure can be adjusted by the adjustment of the drawn amount of the sleeves 13 accordingly.

The headphone device 51 enables the lateral pressure adjustment independently of the vertical adjustment of the hangers 21. The user thus can adjust the lateral pressure easily and precisely so as to be fitted for the shape of the head or a desirable feeling when wearing the headphone device 51.

The headphone device 51 includes the hanger position indicators 121 and the sleeve length indicating portion 137. The user thus can visually recognize the vertical adjustment position of the respective hangers 21 and the drawn amount of the respective sleeves 13 drawn out of the head pad 11, further facilitating the lateral pressure adjustment.

The headphone device 51 enables the lateral pressure adjustment with the smaller number of components.

The headphone device 51 can also allow the user to adjust the lateral pressure only by the extension/retraction of the sleeves 13 with respect to the head pad 11, while eliminating rotating operations such as screw rotation. The headphone device 51 thus reduces the time to adjust the lateral pressure and facilitates the adjusting operation.

The headphone device 51 further allows the user to separately adjust the lateral pressure of the respective right and left housings. The user thus can differently set the lateral pressure on each of the right and left sides to a desired level when the user wants to intentionally change the balance of the lateral pressure on the right and left sides or when the user wants to wear the headphone device 51 with an asymmetric hairstyle, so as to wear the headphone device 51 with a more comfortable feeling.

The present invention is not intended to be limited to the above-described one or more embodiments, and various modifications can be made without departing from the scope of the present invention. The flexural rigidity of the sleeves 13 is preferably, but not necessarily, greater than or equal to that of the band 12.

The flexural rigidity of the part of the band 12 covered with the sleeve 13 drawn out of the head pad 11 is the sum of the flexural rigidity of the band 12 and the flexural rigidity of the sleeve 13. If the flexural rigidity of the sleeve 13 would be smaller than that of the band 12, the flexural rigidity of the part of the band 12 covered with the sleeve 13 is greater than that of the band 12 itself not covered with the sleeve 13.

The extension of the sleeves 13 out of the head pad 11 thus increases the elastic repulsive force when the reference points P2 are shifted to the in-use reference points P2α, so as to set the lateral pressure to a greater level.

The hanger position indicators 121 and the sleeve length indicating portion 137 each serving as the adjusted-amount recognition part TH, may be configured to allow the user to recognize the respective positions either visually or tactually.

The headphone device 51 is not limited to the stereo system including the paired housings 31 as described above, and may be a single ear headphone including a head band placed on the top of the head, a housing 31 corresponding to the ear on one side of the head, and a contact pad in contact with the head on the opposite side on which the other ear is exposed.

The headphone device 51 has been illustrated with the case in which the head band 1 is put across the top of the head, but the head band 1 may be positioned across the back of the head or across the back of the neck.

The headphone device 51 has been illustrated with the case of including the single band 12 inserted through the head pad 11 and extending out of the head pad 11 at both ends, but is not limited to this case. For example, the headphone device 51 may include a pair of bands for each ear without penetrating the fixed wall portion 113 of the head pad 11, each band having one end fixed to the inside and the other end connected with the hanger 21 and the housing 31.

The sleeves 13 are not limited to the case of completely covering the band 12 without exposing outward. For example, the sleeves 13 may each have an opening at the base 132 on which the band 12 is exposed in order to reduce the weight and improve the design and quality. The opening may be a hole such as a circular hole, a rectangular hole, and an elongated hole, or a slit cut at the edge and extending in the longitudinal direction of the base 132.

The sleeves 13 are not limited to the case of being housed in the housing portions 112 in the head pad 11 and drawn out along the band 12. For example, the sleeves 13 may be fitted to the outside of the pad base portion 111 of the head pad 11 and slidable along the band 12.

A headphone device 51A of a modified example is described below with reference to FIG. 7 and FIG. 8. The headphone device 51A includes a head band 1A, a hanger 21, and a housing 31. The head band 1A includes a head pad 11A, a band 12, and a sleeve 13A.

Figure 7:
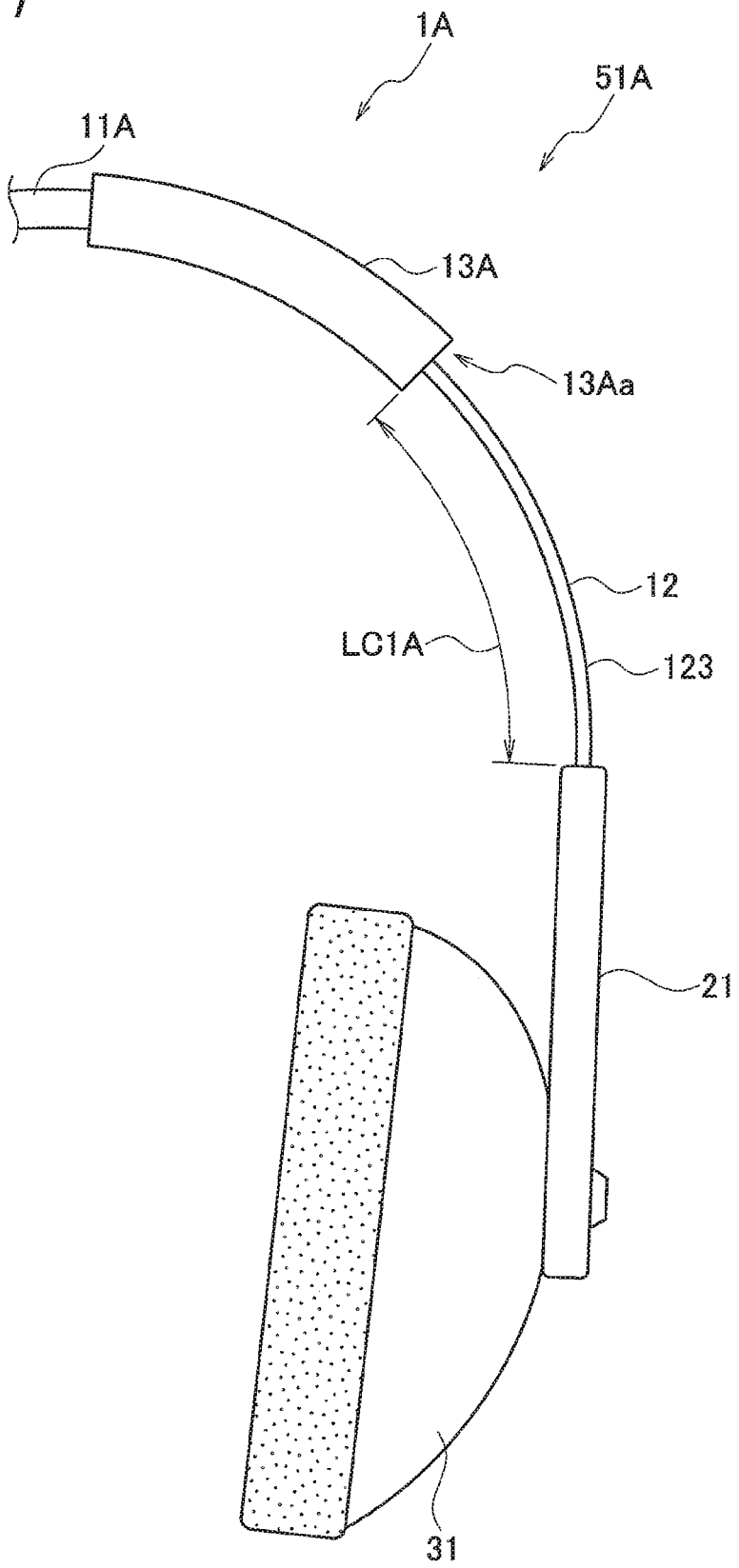
FIG. 7 is a partial front view showing a headphone device of a modified example in a first state according to one or more embodiments.
Figure 8:
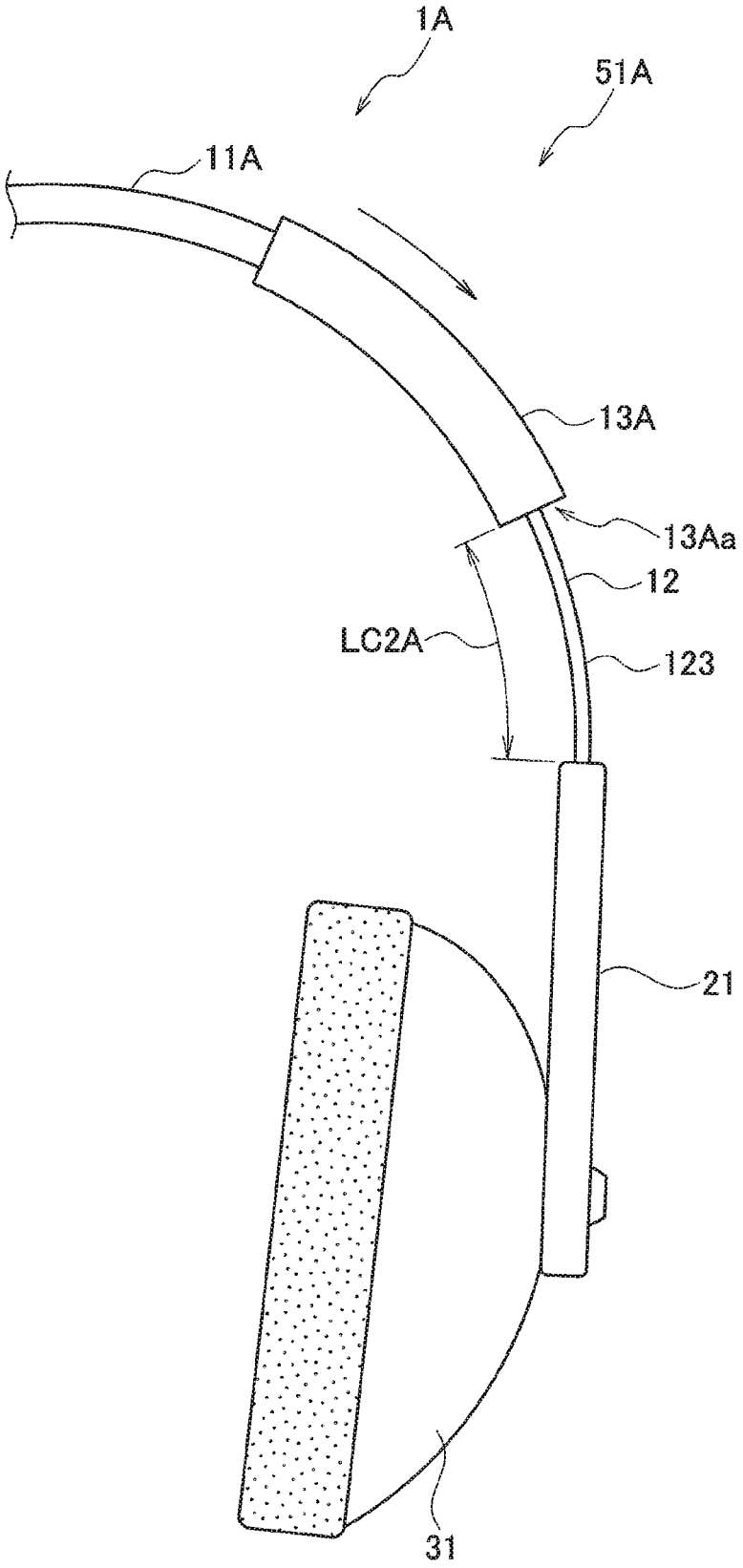
FIG. 8 is a partial front view showing the headphone device of the modified example in a second state according to one or more embodiments.

FIG. 7 illustrates the head band 1A in a first state in which a deformable part 123 of the band 12 has the longest arm length LC1A. FIG. 8 illustrates the head band 1A in a second state in which the deformable part 123 of the band 12 has the shortest arm length LC2A.

The sleeve 13A is fitted to the outside of a pad base portion 111A of the head pad 11A to cover at least part of the head pad 11A, and is slidable in the longitudinal direction while serving as the head pad 11A. The end of the sleeve 13A toward the hanger 21 is provided with a guide portion 13Aa for guiding the band 12 in a slidable state with almost no gap therebetween.

The deformable part 123 of the band 12 has the longest length to have the smallest lateral pressure in the first state in which the sleeve 13A is slid toward the head pad 11A to the maximum. The deformable part 123 of the band 12 has the shortest length to have the largest lateral pressure in the second state in which the sleeve 13A is slid away from the head pad 11A to the maximum.

The headphone device 15A thus facilitates the operation of adjusting the lateral pressure, as in the case of the headphone device 51, depending on the slid amount of the sleeve 13A with respect to the head pad 11A.

What is claimed is:

1. A headphone device, comprising:

a head pad;

a band extending from an edge of the head pad and supporting a housing, via a hanger, housing a speaker unit at a tip of the band, the band being an arcuate member and being flexible; and a sleeve having a pair of opposed penetration holes, defining open ends, a first part of the band being received within the sleeve, a flexural rigidity of the sleeve being greater than a flexural rigidity of the band, the sleeve being extendably and retractably housed in the head pad, wherein a second part of the band extends external to the sleeve and is deformable, a creepage distance of the second part of the band being adjustable according to a drawn amount of the sleeve from the head pad, a lateral pressure applied to right and left ears of a user wearing the headphone device being adjustable according to the drawn amount of the sleeve from the head pad.

2. The headphone device according to claim 1, wherein the second part of the band is located between an end of the sleeve toward the hanger and an end of the hanger toward the head pad.

3. The headphone device according to claim 1, wherein the drawn amount of the sleeve is adjustable between a first state and a second state, the first state being when the drawn amount of the sleeve is zero, and the second state being when the drawn amount of the sleeve is at a maximum.

4. The headphone device according to claim 1, wherein the sleeve includes a mark for indicating a slid amount of the sleeve with respect to the head pad.

* * * * *